US005730403A

United States Patent [19]

Johnson

[11] Patent Number: 5,730,403

[45] Date of Patent: Mar. 24, 1998

[54] ARCHED PANEL WRIST SUPPORT

[76] Inventor: Mark C. Johnson, 32 Galen Ct., Seekonk, Mass. 02771

[21] Appl. No.: 548,563

[22] Filed: Oct. 26, 1995

[51] Int. Cl.[6] ..... B43L 15/00

[52] U.S. Cl. ..... 248/118.1; 248/918

[58] Field of Search ..... 248/118, 118.1, 248/118.3, 118.5, 918; 400/715, 718, 717

[56] References Cited

U.S. PATENT DOCUMENTS

| | | | |
|---|---|---|---|
| 4,973,176 | 11/1990 | Dietrich | 400/715 |
| 5,088,668 | 2/1992 | Grimm | 248/118.3 |
| 5,125,606 | 6/1992 | Cassano | 248/118 |
| 5,131,614 | 7/1992 | Garcia | 248/118 |
| 5,203,527 | 4/1993 | Rubey | 248/118 |
| 5,203,845 | 4/1993 | Moore | 248/118 |
| 5,234,186 | 8/1993 | Powell | 248/118.1 |
| 5,288,042 | 2/1994 | Grimm | 248/118 |
| 5,335,888 | 8/1994 | Thomsen | 248/118.5 |
| 5,348,408 | 9/1994 | Gelardi | 400/715 |
| 5,374,018 | 12/1994 | Daneshvar | 248/118 |
| 5,421,543 | 6/1995 | Rossman | 248/918 |
| 5,439,192 | 8/1995 | King | 248/118.5 |
| 5,507,458 | 4/1996 | Campbell | 400/715 |
| 5,513,824 | 5/1996 | Leavitt | 400/715 |
| 5,572,941 | 11/1996 | Arnos | 400/715 |

FOREIGN PATENT DOCUMENTS

WO 93/21019 10/1993 WIPO .

OTHER PUBLICATIONS

"Rist–eze Flyer" by Keyboard Concepts, 1992.

"Microsoft Natural Keyboard" by M.S. & Joyce Inst. CD55856–0794 1994.

"Safety & Comfort Guide" by Company Computer Chapter 1 184410–001 Aug. 1994.

*Primary Examiner*—Leslie A. Braun
*Assistant Examiner*—Gwendolyn W. Baxter

[57] ABSTRACT

Wrist-supports comprises an arched panel (25) standing on a pair of footing edges (26) extending in a side to side direction. Panel (24) comprises firm material that is thin enough to flex as shown in figure (2). Flexible material sleeve, platform having a channel or keyboard housing is required to constrain panel (25) in its arched configuration, as shown in FIGS. 1, 4, 8, 11, and 12. A separate support is recommended for each wrist. The designs provide surprising benefits of comfort, reach, and wrist-straightening. Many variations are considered. A mobile version with hand strap (36) is shown in FIG. 12. A sloping version is shown in FIG. 7 comprising trapezoidal structure panel (25), shown in FIG. 6.

10 Claims, 7 Drawing Sheets

ARCHED PANEL WRIST SUPPORT

FIELD OF INVENTION

This invention relates to wrist and palm supports.

DISCUSSION OF PRIOR ART

Over the past century, many designs for typing supports have been invented. The concept of a low, narrow platform situated along the length of a keyboard is very well established. Though the materials have evolved, this is still the most common design. Wrist rests commonly used today comprise a simple strip of foam rubber that lies in front of the computer keyboard. These wrist rests are approximately three to four inches wide and three fourths of an inch thick. Powell's U.S. Pat. No. 5,234,186 and Limingoja's WO Patent 93/21019 show minor variations on this standard design.

However, the prior art does not offer a simple and restful design that dynamically conforms to the user's physique while still providing firm support. The prior art does not offer such a design that isolates each hand while remaining an elegantly integrated unit. It does not offer such a design that is highly compact for storage, packaging and portability. Nor does it offer such a design that is lightweight, thus enhancing portability and reducing freight costs. The prior art does not offer such a design that allows movement back and forth from a keyboard to a mouse. It does not offer such a design that is easily and inexpensively adjustable. It does not offer such a design that unobtrusively mimics proper hand posture when a wrist support is not present.

OBJECTS AND ADVANTAGES

Wrist-rests are almost a necessity to millions of people who use computer keyboards. Holding one's hands above the keyboard is perhaps the best way to keep one's wrists straight when typing. However, holding one's hands above the keyboard is virtually impossible given the amount of time office personnel spend at keyboards in today's computerized world. Also, holding one's hands above the keyboard for very long periods of time is itself difficult and tiring. It can cause discomfort and pain in one's arms, shoulders, back, and neck. Even if a typist holds his or her hands up when typing, a wrist-rest should be present for pausing in one's work and taking momentary breaks. Therefore, the broad object of the invention is to provide typing wrist and palm supports that are surprisingly superior to the wrist-rests currently available.

A specific object of the invention is to alleviate and prevent carpal tunnel syndrome in computer users and typists.

A specific object of the invention is to provide a new type of wrist-rest that feels unusually comfortable and natural.

A specific object of the invention is to replicate the hand motion of proper typing technique when a wrist-rest is not present.

A specific object of the invention is to create wrist supports that will naturally respond to the ergonomics of typing, thus improving hand comfort.

A specific object of the invention is to create wrist supports that will naturally respond to the dynamics of typing, thus improving finger range.

A specific object of the invention is to make any slight bending of one's wrists a less tensing motion.

A specific object of the invention is to provide wrist-rests where the height may be easily and inexpensively modified to suit the user and keyboard.

A specific object of the invention is to provide wrist-rests that are cost effective to manufacture.

A specific object of the invention is to create wrist-supports that do not occupy much space in stores and in shipping.

A specific object of the invention is to create wrist-rests that can be used for both a keyboard and a computer mouse.

A specific object of the invention is to create portable wrist-rests.

Further objects and advantages of the Arched Panel Wrist Support invention will become apparent from a consideration of the following drawings and descriptions.

REFERENCE NUMERALS IN DRAWINGS

20) Constraining sleeve.
22) Contact fabric.
23) Top material.
24) Base material.
25) Structure panel(s).*
26) Footing Edge(s).**
27) Side Edge(s).*
28) Anti-Skid Surface.
29) High friction stripe(s).**
30) Panel ribbing.
31) Arched panel concavity.
32) Panel Channel.
33) Channel bed.
34) Channel barrier(s).**
35) Strengthening fibers.
36) Wrist or hand strap.
38) Footing block.

39) Buffer cushion strip.
40) Footing edge fillister(s).**
42) Anti-skid mat.
44) Keyboard/wrist-rest tray.
46) Tray platform.
48) Tray wall(s).**
50) Keypad or keyboard housing means.
53) Person's wrist(s).
54) Person's palm(s).*
55) Person's lower forearm(s).

*(a or b indicates left or right respectively.)
**(a or b indicates front or back respectively.)

SUMMARY OF INVENTION

The present invention is a simple, yet new and beneficial design for constructing wrist supports. In a preferred embodiment, the Arched Panel Wrist Support commences with a flexible sleeve.

A structure panel is cut into a rectangular shape having a length substantially equal to the length of the sleeve. The panel width, though, is sized to be ten to twenty percent greater than the sleeve width when the sleeve is laid flat. The structure panel is made of firm plastic, but it is sufficiently thin to flex.

The structure panel is inserted into its constraining sleeve. Because it is wider than the sleeve's doubled over material, the structure panel must form an arch to fit in the sleeve. The panel thus forms a three dimensional shape constituting a surprisingly comfortable and effective wrist-support.

The Arched Panel Wrist Support invention allows for many different embodiments. The disclosed wrist support recommends a separate unit for each hand, sharing a common base. Mobile versions that can be slid and/or lifted are appropriate for use with both a computer keyboard and mouse. The specification shows three means, besides the flexible sleeve, for constraining the structure panel in its arched configuration.

DETAILED DESCRIPTION OF INVENTION

Invention Fundamentals

Figure 1:
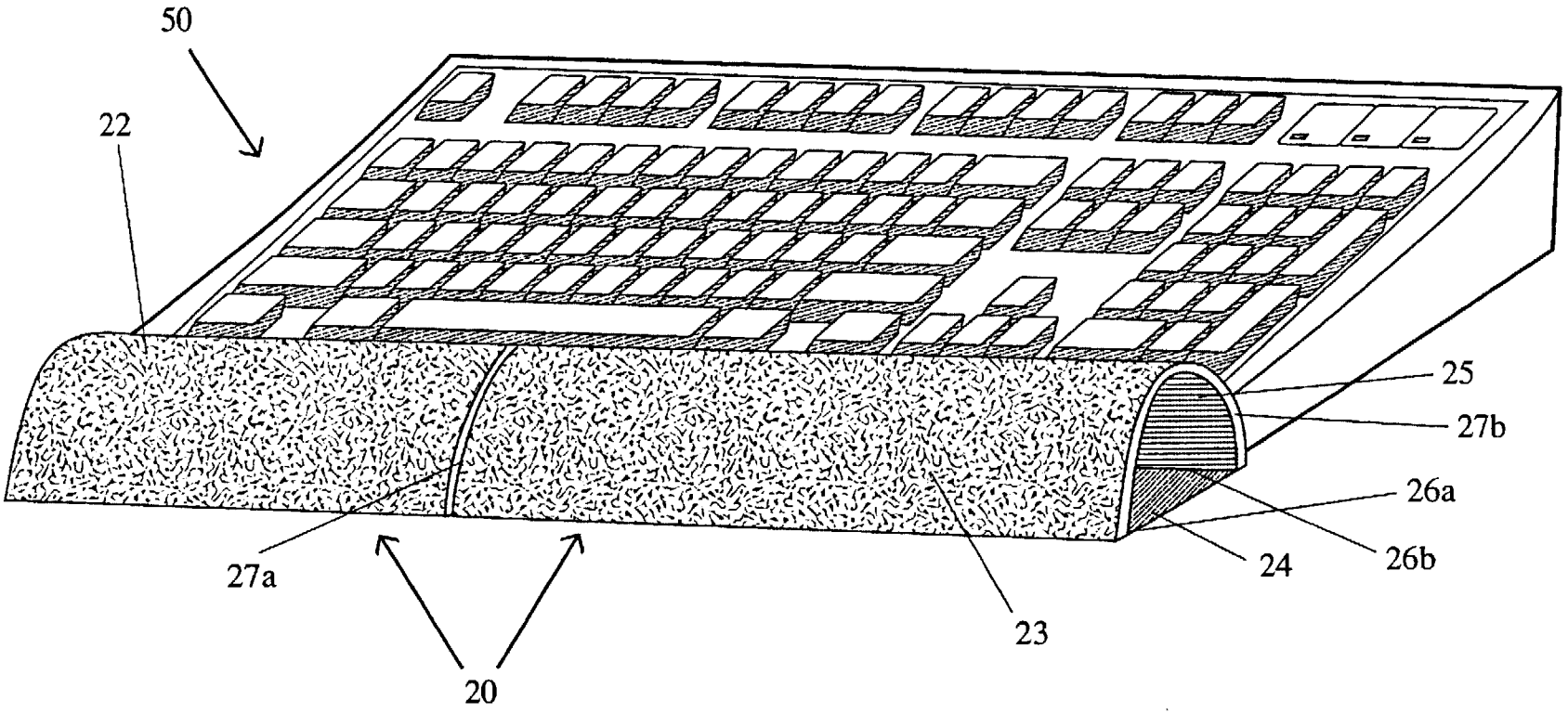
FIG. 1 is a perspective view of a pair of Arched Panel Wrist Supports, positioned for use, adjacent a standard computer keyboard.

In accordance with the disclosed wrist support invention, FIG. 1 is a perspective view of a preferred embodiment. The wrist support is shown in front of a standard computer keyboard, keyboard or keypad housing means 50, as it would ordinarily be positioned for use. Technically, FIG. 1 shows two Arched Panel Wrist Supports, one for each hand. This is the recommended setup. FIG. 1 shows the side by side wrist-rests substantially extending along the length of keyboard housing means 50.

In FIG. 1, the Arched Panel Wrist Supports comprise a constraining sleeve 20. Constraining sleeve 20 is simply a tubular stretch of flexible material.

FIG. 1 shows an arched structure panel 25 inside constraining sleeve 20. Arched panel 25 should be comprised of substantially firm material. It is preferably made of fairly firm plastic, but it may be made of various other materials. Though made of somewhat rigid material, such as rigid PVC, structure panel 25 is thin enough to be fairly flexible. This means it should flex under a force that a person's hands can readily exert. If it is made of rigid PVC, the panel may be about one thirty-second of an inch thick, much like the sheet or roll stock used for standard credit cards.

However, in the preferred embodiment, structure panel 25 comprises polyolefin material, polyethylene or polypropylene. This is because these materials have very suitable flexural properties. A suitable polyolefin should be between 0.025" and 0.075" thick. It is not easy to pinpoint the optimum gauge. There are thousands of grades of polyethylene (PE) and polypropylene (PP). There are even several categories including: low density PE, high density PE, medium density PE, high molecular weight PE, ultra-high molecular weight (UHMW) PE, modified PE, PP homopolymer, PP impact copolymer, and various blends. Therefore, the optimum gauge will vary. However, PE's, approximately forty thousandths of an inch thick, can balance ideally between firmness and comfort.

Figure 2:
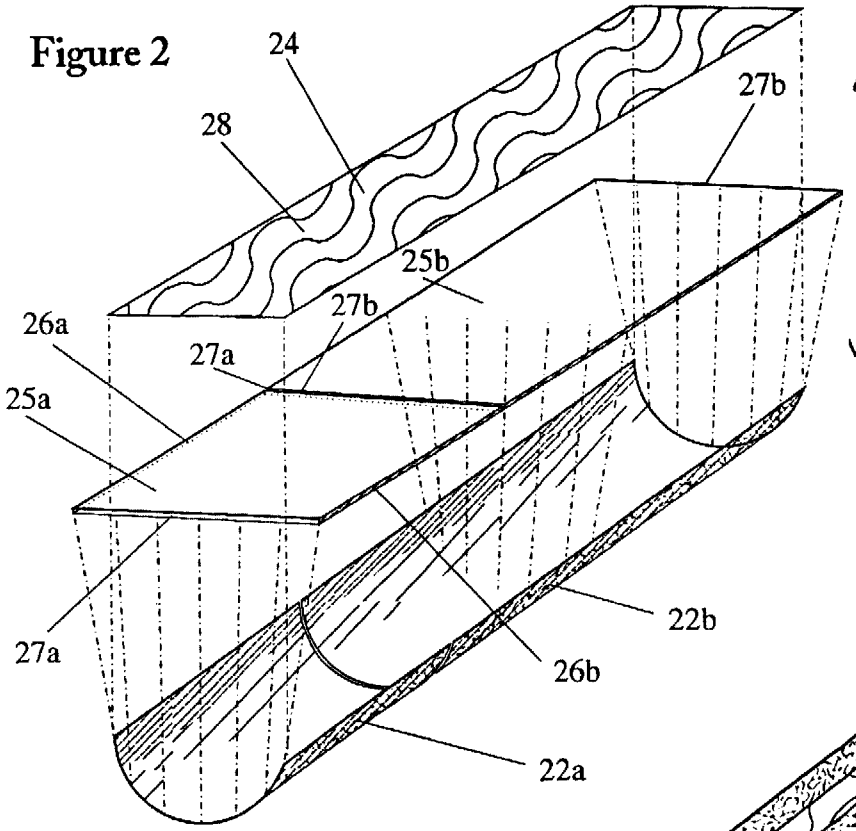
FIG. 2 is an exploded view of the wrist-rests in FIG. 1.

Arched panel 25 is made as a flat sheet in the main embodiment. FIG. 2 illustrates this feature. Shown is an upside down, exploded view of the wrist-rests in FIG. 1. In FIG. 2, structure panels 25 are flat, while their projection lines indicate how they become arched or bowed.

Referring to both FIGS. 1 and 2, structure panel 25 has a disjoint pair of footing edges 26 lying in a direction from left to right. Bearings are understood to be taken from the user's perspective. Structure panel 25 has a side edge **27*a* spanning between the left extremities of footing edges 26. Similarly, it has a side edge 27*b* spanning between the right extremities of footing edges 26. Footing edge 26*a* is designated as the footing edge at the front of the wrist support. Footing edge 26*b*** is designated as the footing edge at the back of the wrist support.

Structure panel 25 has a sheetlike, planar configuration, but, being fairly flexible, it can take on an arched configuration. In said arched configuration footing edges 26 are drawn nearer each other while remaining substantially coplanar. As shown in FIG. 1, side edges 27 and the body of structure panel 25 bow upward in said arched configuration. The arched panel, being made of substantially firm material, stands on footing edges 26 and is adequately supportive without laying upon any additional support member.

In the preferred embodiment, constraining sleeve 20 is comprised of a contact fabric 22 and a base material 24. Contact fabric 22 is preferably a soft, flexible, and slick fabric that will absorb mild perspiration. It wraps over the crest of the arched panel. Contact fabric 22 is so-called because it is the portion of sleeve 20 that will contact the person's wrist. A cotton flock or a polyester knit, are examples of suitable top coverings. The fibrous pattern of contact fabric 22 depicts flock. Flock is preferred became the flock fibers tend to orient themselves to reduce friction. Of course, many fabrics will suffice.

Base material 24 also should comprise flexible material. However, it preferably has an anti-skid or high friction bottom surface 28, as shown in FIG. 2. Anti-skid surface 28 can help prevent the wrist-rest from shifting or sliding when in use.

Since sleeve 20 is soft and flexible, arched panel 25 must provide the wrist-rest's firmness. Referring again to FIG. 1, arched panel 25 defines the flexible sleeve's shape. Flexible sleeve 20 is still essential, however, to constrain structure panel 25 in the arched configuration. Flexible sleeve 20 is said to be an arched panel constraining means.

FIG. 2 shows the embodiment in FIG. 1 where there are two Arched Panel Wrist Supports for use by a single user. A smaller wrist support lies on the left side of a second, longer wrist support. FIG. 2 shows left structure panel **25*a* and right structure panel 25*b* lying side by side. FIG. 2 also shows two contact fabric pieces 22 lying side by side. Observe, however, that there is only a single piece of material that serves as base material 24 for both wrist supports. The base materials 24 of the left and right sleeves 20** are connected or interconnected along their right and left edges respectively. Each coupled wrist support can uphold one of the user's wrists. Among other benefits, the coupling of the left and right hand wrist supports prevents them from sliding or shifting.

Figure 3:
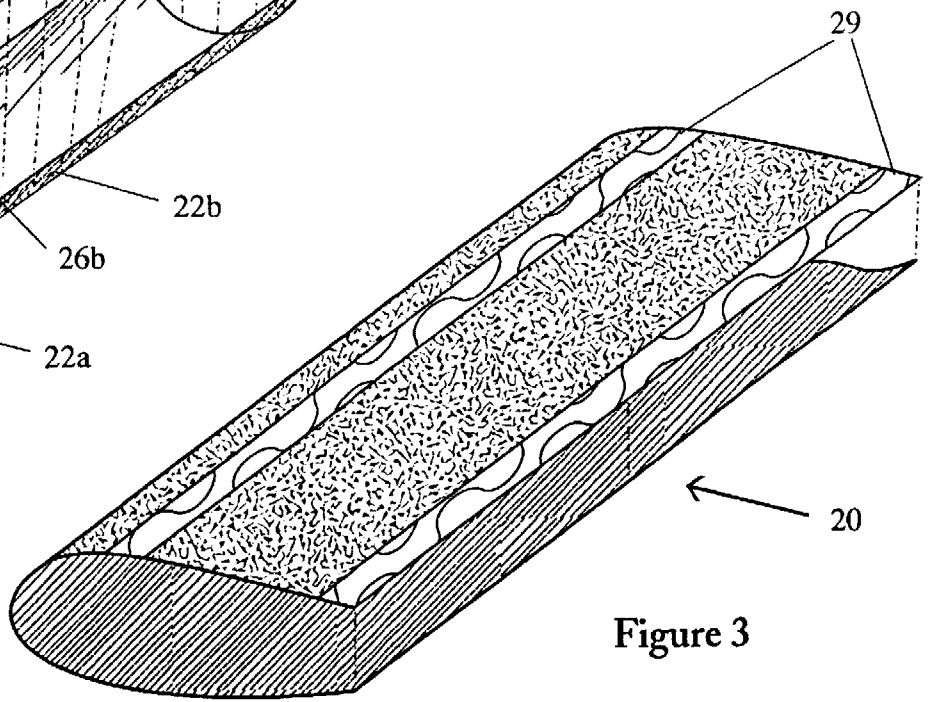
FIG. 3 is an exploded view of a panel sleeve.

FIGS. 2 and 3 reflect how sleeve(s) 20 can be made. Sleeve 20 and structure panel 25 have substantially equal longitudinal dimensions. In FIG. 2, contact fabric 22 is draped to create the accurate amount of slack. Then contact fabric 22 and base material 24 are connected along their longitudinal edges. In this specification, the term "longitudinal" expresses the direction from side to side. This method of construction, allows the manufacturer to measure out different materials for the top and base respectively.

FIG. 3 is another exploded view. FIG. 3 shows a different method of manufacturing constraining sleeve 20. In FIG. 3, a single piece of fabric is folded over and connected along its longitudinal edges. FIG. 3 demonstrates that only sleeve 20 is required. Having separate contact fabric 22 and base material 24 is not essential. It is clear from FIGS. 2 and 3 that sleeve 20 is open at both ends. This is the preferred embodiment.

The connecting of constraining sleeve 20 may be achieved by sewing or by other methods. The method will often depend on the materials used. For instance, it may be desirable to use unsupported vinyl and to create sleeve 20 by radio frequency sealing.

Contact fabric 22 may be distinct from panel sleeve 20. For instance, it might be a label or patch that is adhered by ironing. However, the fabric will normally be an intrinsic portion of the sleeve. FIG. 2 illustrates how sleeve 20 will basically consist of contact fabric 22 and base material 24 in the preferred embodiment.

Figure 4:
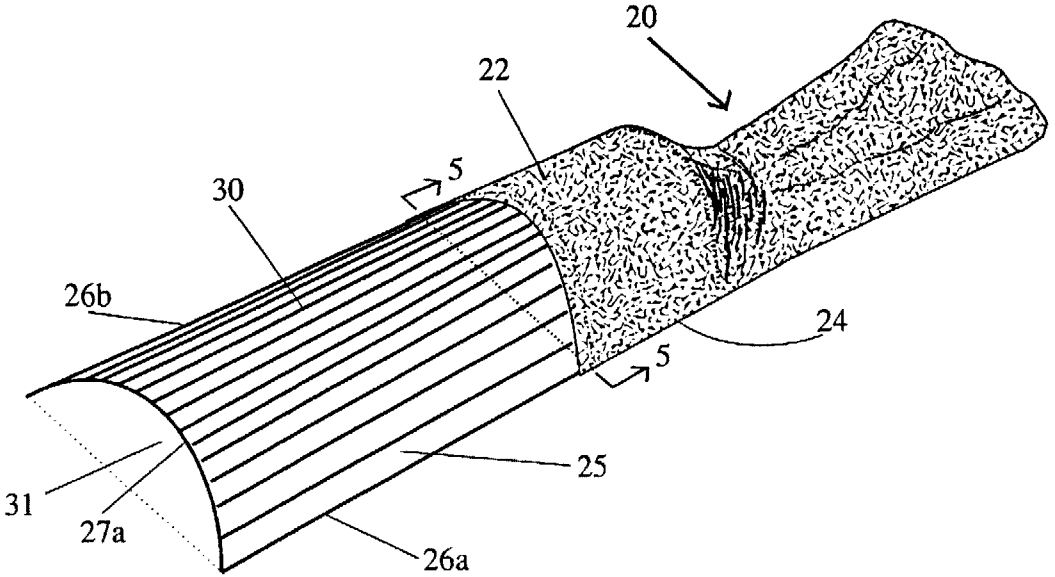
FIG. 4 is a perspective view of an arched structure panel partially inserted into the panel sleeve.

FIG. 2 does not reflect how structure panel 25 is normally inserted into sleeve 20. Panel 25 normally is inserted into sleeve 20 after sleeve 20 has been made. Usually, panel 25 will be flexed and fed through sleeve 20. FIG. 4 illustrates this action. FIG. 4 is an elevational perspective view with arched panel 25 partly slid into constraining sleeve 20. This is an assembly operation that the user may perform. FIG. 4 displays how panel 25 arches when confined within constraining sleeve 20. There is no need to fasten arched panel 25 to panel sleeve 20. Panel 25 is simply placed in position. The natural springiness of arched panel 25 holds it in place.

Figure 5:
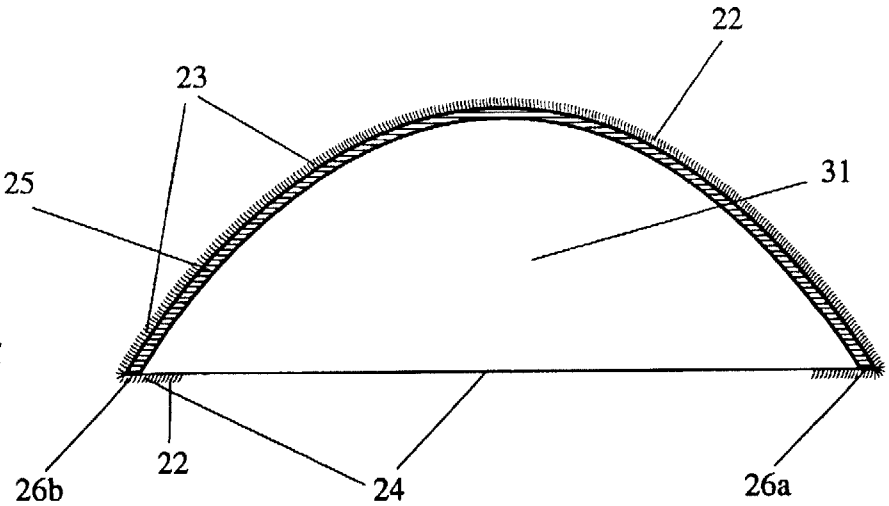
FIG. 5 is a cross-sectional view showing a contact fabric extending to the base of the wrist support.

FIG. 5 is a transverse, vertical cross-section of the wrist support in FIG. 4 along the plane indicated by 5—5. In the present specification, the term "transverse" signifies the direction from front to back. FIG. 5 displays how arched panel 25 forms and straddles a concavity 31 when in the arched configuration. FIG. 5 shows how sleeve 20 wraps around both arched structure panel 25 and concavity 31. Sleeve 20 hugs the convex surface of arched panel 25 and the bottom face of concavity 31. Structure panel 25 is thereby bound in said arched configuration.

In FIG. 3, there is no clearly defined base material. FIG. 5 shows contact fabric 22 extending around to the base. Thus FIGS. 3 and 5 demonstrate another important point. The base and top materials are not defined by the material making up sleeve 20. They are defined by arched panel 25. Base material 24 is that portion of constraining sleeve 20 that underlies concavity 31 and footing edges 26. Top material 23 shown in FIG. 5 is that portion of constraining sleeve 20 that lies over arched panel 25. In FIG. 5, top material 23 is a sub-portion of contact fabric 22. In FIGS. 1 and 2 the contact fabric 22 and top material 23 substantially coincide. This is often desirable but it is not mandatory. Contact fabric 22 may be a sub-portion of top material 23.

It is useful to analyze quantitatively the relationship between arched panel 25, and sleeve 20's top and base portions. Dimensionally, the arc of sleeve top 23 in transverse direction is substantially equal to the width of panel 25. Call this quantity $W_p$. Call the base width $W_b$. FIG. 5, demonstrates that the circumference of the sleeve is substantially equal to the base width plus the panel width. Now, call the width of sleeve 20 when laid or pressed flat $W_s$. In the present specification, the term "width" represents the dimension in transverse direction. The term "sleeve width" refers to the sleeve's transverse dimension when it is placed flat. Clearly, the flexible sleeve forms two substantially equal sized layers of material when flat. Therefore, making some simplifying assumptions, the circumference of sleeve 20 is $2W_s$. Summarizing:

The circumference of sleeve 20$=W_b+W_p=2W_s$.

This is a useful relationship when selecting dimensions for the Arched Panel Wrist Support. However, this is only a relationship. It does not uniquely define the shape of the wrist-rest. A desirable shape is most easily selected by educated guess and by trial and error. The engineer may start by selecting the desired base width, such as 4 inches.

Obviously, panel 25 must be wider than the base width. Otherwise, panel 25 will not arch but will remain in its substantially two-dimensional state. Therefore, the engineer may begin by making the panel width barely larger than the base width. The sleeve is tailored to conform to the above equation. If the height is not correct, then the panel width and the sleeve circumference are increased equally. Then the wrist-rest height is checked again to see if it is the right height. This describes how an engineer may select the Arched Panel Wrist Support dimensions.

Observe that given a sleeve size, the height may be adjusted by varying the panel width. If the panel width is increased, the height will increase. If the panel width is decreased, the height will decrease. Thus, a user may be provided with panels 25 having different widths. The user then can select the one he/she prefers. The panel widths and consequent heights can range significantly. The exact dimensions are sometimes less important than the proportions. The panel width may be as little as 2% greater than the sleeve width (half the sleeve circumference) and still provide adequate height. On the other hand, the panel width may be 25% greater than the sleeve width to provide the desired height. For example, the panel width could be 5¾ inches with a 4⅝" sleeve width. Most users will feel more comfortable in the middle of this range—where the panel width is about 15% greater than the sleeve width.

Invention Variations and Extensions

Anti-skid surface 28 may achieve its high friction surface by comprising foamed material or ridges as portrayed in FIG. 2. However, a smooth, glossy finish often provides a grippier surface. The material itself is the most important factor in the coefficient of friction. Rubberized fabrics are ideal. Plasticizers are available to give vinyl a tacky feel. Urethane coatings may achieve the same purpose. Vinyl comprising an anti-skid bottom surface is a recommended base material 24 for reasons of manufacturing ease.

It is oily important to have a high coefficient of friction at the edges of the wrist-rest base. This is because the high friction surface is needed where the weight is supported. The weight is supported at footing edges 26. Therefore, only base material 24 that underlies footing edges 26 needs to have an anti-skid surface. FIG. 3 shows high friction stripes 29. High friction stripes 29 can localize the high friction surface to where it is advantageous. High friction stripes 29 may be coated on sleeve 20. This may be achieved efficiently by using a roller or other applicator. High friction stripes 29 may be applied to the sleeve material before it is manufactured into sleeves. Suitable coatings can be obtained from those skilled in the field of coatings and laminates.

FIG. 4 shows panel ribs or ribbing 30. Panel ribbing 30 can be used to increase the durability and strength of structure panel 25. The ribbing purposely extends in the longitudinal direction. This ribbing configuration will not impede significantly panel 25 from arching. However, it can help prevent destructive distortions of arched panel 25. Panel ribbing 30 is only an option. FIG. 2 shows panel 25 without any ribbing. It is currently believed to be more economical to leave out ribbing and to replace the arched panel if necessary.

Figure 6:
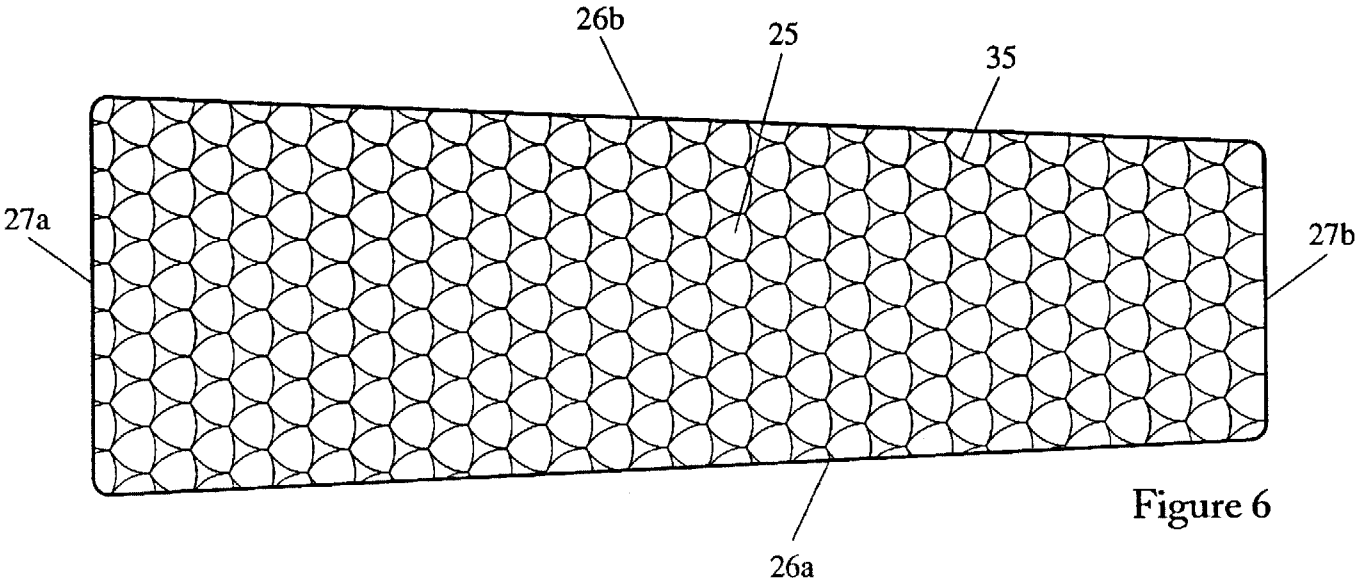
FIG. 6 is a plan view of a trapezoidal structure panel comprising reinforcing fibers.

FIG. 6 is a plan view of a structure panel 25 having special features. This structure panel comprises strengthening fibers 35. Strengthening fibers 35 can serve the same general purpose as ribbing 30. Strengthening fibers 35 could form a pattern as shown. Less expensively, matter such as glass fibers could be randomly distributed in plastic structure panel 25. In either case, the plastic is said to be infused with strengthening fibers 35.

In FIG. 6, the structure panel is in its planar configuration and has another special feature. It is trapezoidal. Footing edges 26 are nonparallel in structure panel 25's planar configuration. The above discussion about the relationship between panel, base, and sleeve widths still applies. Only in FIG. 6, the panel width is not constant. It decreases linearly from left to right. Therefore, the arc of the top of the wrist-rest in transverse direction will decrease linearly. We begin by assuming that sleeve 20 has a constant width. Then the arched panel 25 would arch higher at its wider end than it would at its more narrow end. In sum, the wrist-rest will slope from one end to the other.

If the sleeve circumference is constant, however, as the arc of the top of the wrist-rest decreases, the base width will increase. This may not be desirable. Fortunately, the increase in the base width can be offset by decreasing the sleeve circumference in sync with the arched panel width. As an example, suppose that trapezoidal structure panel 25 is 6 inches wide on the wider end and 5 inches wide on the other end. Suppose further that the sleeve circumference is 10 inches on the left end. Then the base width on the left end would be 10–6=4. If the sleeve circumference is held constant, the base width at the other end would be 10–5=5. However, we may decrease the sleeve circumference simultaneously with the panel width; i.e., the sleeve circumference also decreases by 1 inch. The base width at the right end then becomes 9–5=4, which is the same as on the left end.

Figure 7:
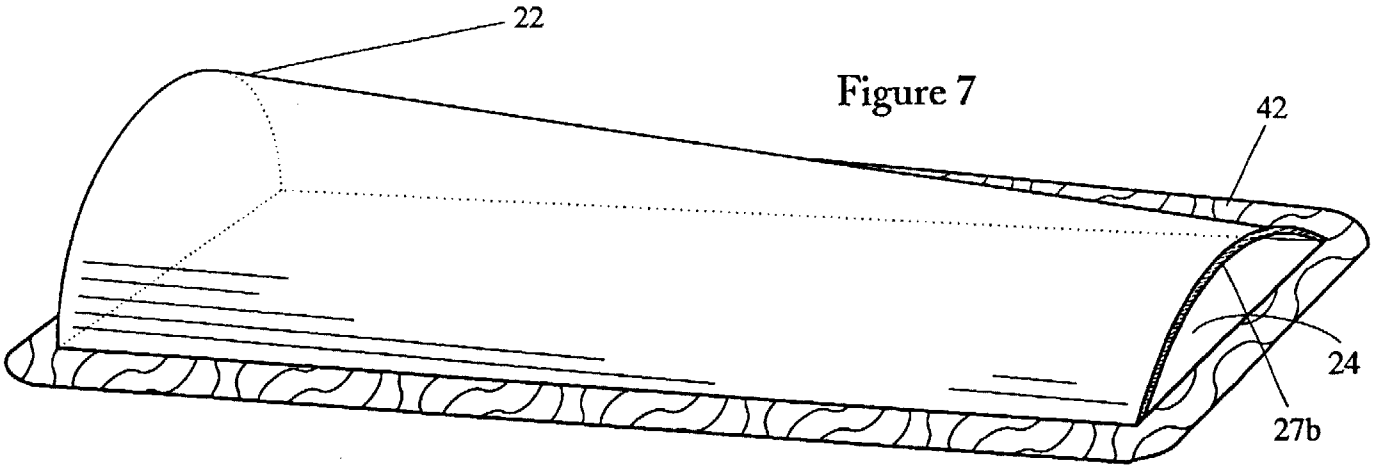
FIG. 7 is a perspective view of a sloping embodiment.

FIG. 7 is a perspective view of a sloping embodiment of the Arched Panel Wrist Support, emphasizing its shape. In FIG. 7, the increase in base width is offset by a decrease in sleeve circumference.

The tendency for the base width to change in a sloping embodiment can be offset completely as in the preceding example, or the offset can be partial. Offsetting the increase in base width only partially is a useful geometry for today's most popular ergonomic keyboards. There is another possibility for varying the sleeve width/circumference (within an individual wrist-rest). The sleeve width may decrease along with the panel width to narrow the base width while decreasing the height. This results in a change in size from one end to the other, while keeping a more proportional shape. This design option may be preferable in certain applications.

Trapezoidal structure panel 25 in the Arched Panel Wrist Support is a cost effective way to make sloping wrist supports. In sloping embodiments, structure panel 25 should be a symmetric trapezoid about its longitudinal axis. This will ensure that the sloping wrist-rest sits level. Similarly, when varying the sleeve width, the flat sleeve should be a symmetric trapezoid. This is equivalent to constraining sleeve 20 having a truncated, slightly conical shape.

It should be noted that in FIG. 6 structure panel 25 is said to be trapezoidal as it is substantially a quadrilateral. The corners have a radius, yet this does not alter the manifestly four sided, trapezoidal shape. Rounded corners are desirable for two reasons. First, they protect the user from abrasions. Second, soft corners make it easier to feed arched panel 25 into constraining sleeve 20.

FIG. 7 shows another method to prevent the disclosed wrist-rest from slipping or sliding. In combination with the sloping wrist-rest is an anti-skid mat 42. Anti-skid mat 24 simply underlies the wrist support. Anti-skid mat 42 is not attached. Anti-skid mat 42 may be made of sponge rubber, such as neoprene.

Figure 8:
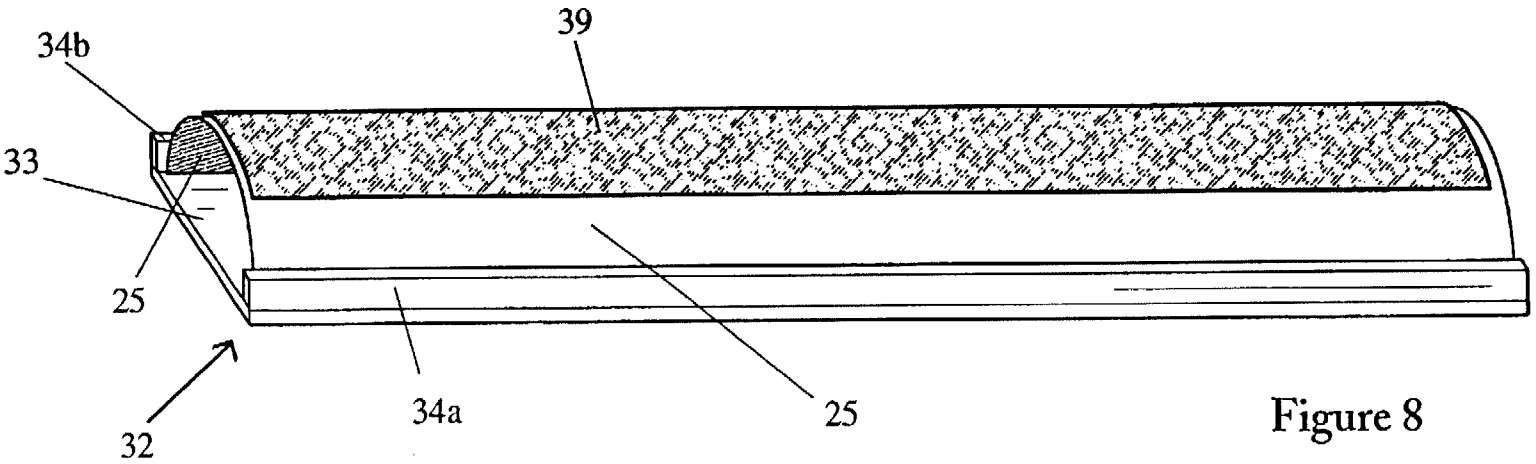
FIG. 8 is a perspective view of an embodiment where the structure panel is held in its arched configuration by a panel channel.

FIG. 8 is a perspective view of another embodiment of the Arched Panel Wrist Support. In FIG. 8, constraining sleeve 20 is replaced by a panel channel 32. Like sleeve 20, panel channel is a means to hold structure panel 25 in the arched configuration. Therefore, like the flexible sleeve, panel channel 32 is an arched panel constraining means.

Panel channel 32 is a low, box-like structure, open at its top. Panel channel 32 comprises a substantially planar channel bed 33. Channel bed 33 has a pair of disjoint, rectilinear boundaries, lying substantially in a direction from side to side (left to right). Panel channel 32 further comprises a pair of channel barriers **34*a* and 34*b* or a pair of restricting means. Channel barrier 34 is a lip, wall, or other restricting means to block sliding off the channel bed. The two channel barriers 34** lie, in one-to-one relation, along said pair of channel bed boundaries.

Channel barriers **34*a* and 34*b* may rise substantially perpendicular to channel bed 33 as shown in FIG. 8. On the other hand, it is desirable that channel barriers 34 form slightly acute angles with channel bed 33**.

The ends of panel channel 32 may be open as in FIG. 8. Clearly, though, the channel walls could line the entire perimeter of channel bed 33. Barriers, therefore, also could be present at the sides. This could be useful for strengthening panel channel 32. It also would prevent the arched panel from sliding. Panel channel 32 may be made of any appropriately rigid material. Various types of rigid plastic, metal, and wood are examples of suitable material for the construction of panel channel 32.

Completing the panel channel embodiment of the invented wrist-rest is arched structure panel 25. The arched panel's footing edges 26 are positioned on panel channel 32. One of footing edges 26 then abuts one of said channel barriers 34, and the other footing edge abuts the other channel barrier. Structure panel 25 is thereby constrained in said arched configuration.

Structure panel 25 is again a sheet of firm plastic that is thin enough to flex. In the flexible sleeve embodiment, planar structure panel 25's transverse dimension (width) was greater than the flexible sleeve's width. In the panel channel embodiment, structure panel 25's width is greater than channel bed 33's width. In the panel channel embodiment, however, the wrist-rest's base width is equal to the channel bed width. The base width does not vary along with the panel width as with the flexible sleeve.

The tendency for arched panel 25 to return to its planar sheet state holds it in place. In the embodiment of FIG. 8, optional top buffer cushion strip 39 is mounted over the crest of arched panel 25. Buffer cushion 39 may comprise a narrow length of pressure sensitive foam.

Figure 9:
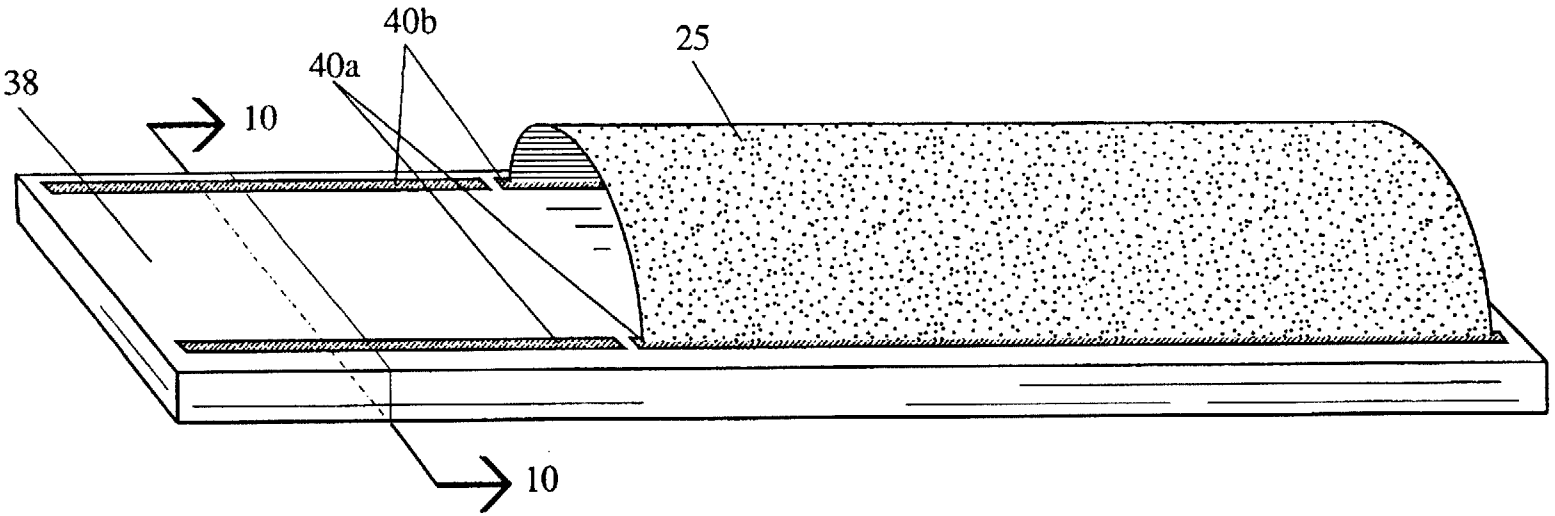
FIG. 9 is a perspective view of an embodiment where the structure panel is constrained in its arched configuration by another means.

FIG. 9 is a perspective view of the disclosed invention, showing a third arched panel constraining means. The constraining means of FIG. 9 comprises a fairly squat footing block 38. Footing block 38 is merely a slab of appropriately unyielding material. Suitable materials include wood, rubber, plastic, and adequately dense foam material.

Penetrating the top of footing block 38 are pairs of rectilinear, disjoint fillisters 40*a* and 40*b*. Fillister 40 is simply a narrow groove or a slit in footing block 38. Fillisters 40 substantially extend in a side to side (left to right) direction. One of the arched panel's footing edges stands in one of fillisters 40. Standing in the other fillister is the other footing edge.

Observe that footing block 38 of FIG. 9 is designed to accommodate two wrist supports. This is in keeping with the theme of a distinct Arched Panel Wrist Support for upholding the user's left wrist, and a distinct one for upholding the user's right wrist. Only right arched panel 25 is present, though, to show more clearly the left pair of fillisters 40*a* and 40*b*. The dot pattern on arched panel 25 depicts a textured surface, such as a matte or sandblast finish. This can help make arched panel 25 more slick, allowing the user to slide his/her wrist along the panel more easily.

Figure 10:
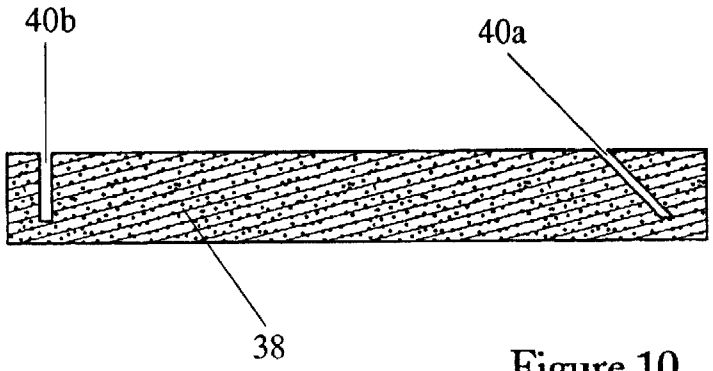
FIG. 10 is a vertical cross-section of the embodiment in FIG. 9, taken in the front to back direction as indicated by 10—10.

FIG. 10 is a vertical cross-section of footing block 38 in FIG. 9. The transverse viewing plane is indicated by 10—10. FIG. 10's purpose is to show fillisters 40*a* and 40*b*. In particular FIG. 10 shows fillister 40*a* at the front of the wrist support being significantly angled off the vertical. None, one, or both fillisters 40 can descend at an angle of varying degree.

Figure 11:
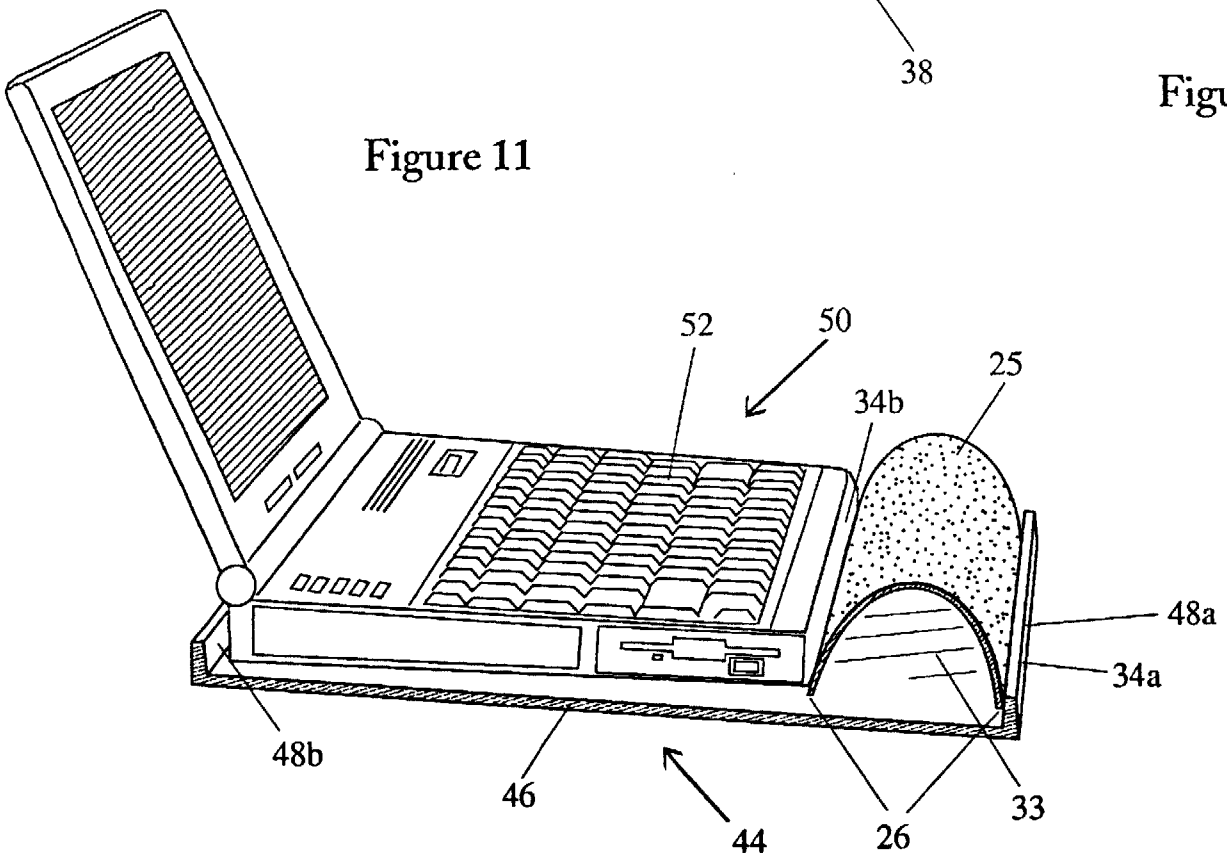
FIG. 11 is a perspective view of an embodiment where the structure panel is constrained between the lip of a tray and a portable computer.

FIG. 11 shows another version of the Arched Panel Wrist Support. FIG. 11 is a perspective view from the left side. The drawing shows a tray 44. Tray 44 comprises a tray platform 46, a planar piece of appropriately rigid material. Platform 46 has a front boundary and a back boundary. These boundaries are disjoint and lie substantially in a direction from side to side (left to right). Tray 44 also comprises a front wall 48*a* rising above platform 46 along the front platform boundary. Similarly, a back wall 48*b* rises above platform 46 along the back platform boundary. Tray walls 48 are lips or other short structures protruding upward. Tray walls 48 are affixed to tray platform 46.

FIG. 11 portrays a portable computer. The portable computer comprises a key pad 52. Therefore, the computer is a means 50 to house computer keypad 52. Keyboard housing means 50 is seated on tray 44. Arched panel 25 is also seated on tray 44. One of the arched panel's footing edges 26 abuts front wall 48*a*. The other footing edge abuts the front of keypad housing means 50. The back of keypad housing means 50 abuts back wall 48*b*. Consequently, arched structure panel 25 is wedged between front wall (48*a*) and the computer, keyboard housing means 50. In turn, the computer is wedged between arched structure panel 25 and back wall 48*b*.

This keyboard/wrist-rest tray method to hold structure panel 25 in its arched configuration is a special case of the panel channel method. In panel channel terms, front wall 48*a* is one of channel barriers 34. The front of the computer is the other channel barrier 34*b*. Channel bed 33 is that portion of tray platform 46 between front wall 48*a* and keyboard housing means 50.

To ensure a working system, a means should be included to keep keyboard housing means 50 in a fixed position. In FIG. 11 back wall 48*b* constitutes this means. Note, that a tangible means, such as back wall 48*b*, may not always be necessary. Gravity may be able to hold in place the portable computer, or other keyboard housing means.

Figure 12:
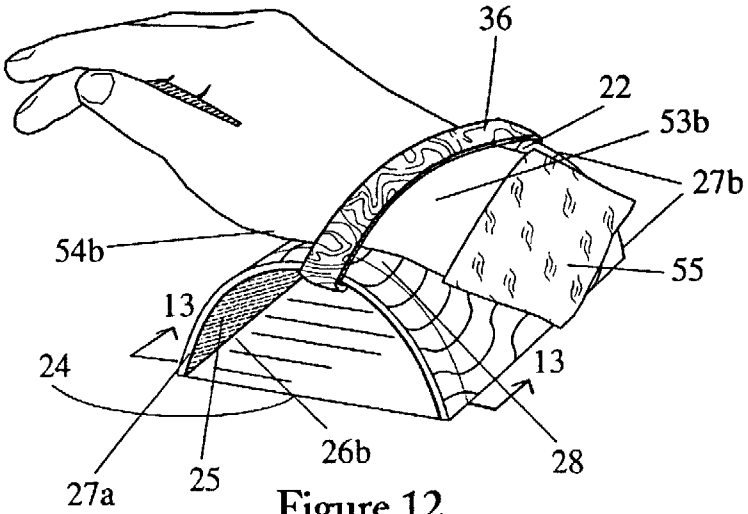
FIG. 12 is a perspective view of a mobile embodiment that can be slid and lifted.

FIG. 12 shows an embodiment of the Arched Panel Wrist Support that is designed to be slid and moved. The mobile wrist-rest is comparatively narrow since there is no need for it to extend along the whole length of a keyboard housing means. FIG. 12's mobile embodiment represents a flexible sleeve version of the Arched Panel Wrist Support. Flexible sleeve 20 again has contact fabric 22 and base material 24. However, the feel or hand of the top and base materials is reversed.

In FIG. 12, base material 24 comprises a slick bottom surface so that the wrist-rest may readily slide. Slick bottom surface constitutes a gliding means to allow the wrist support to move around its supporting surface. In contrast, contact fabric 22 comprises an anti-skid or high friction surface 28. This anti-skid top surface allows the wrist-rest to significantly tack to a person's wrist 53*b*. Complementing anti-skid surface 28, is a hand or wrist strap 36. In FIG. 12, hand strap 36 is a belt (36) comprising flexible material. This belt loops around the body of arched structure panel 25. It loops over and under side edges 27, and it passes through the panel concavity. Wrist strap 36 tethers the user's hand to the wrist support. Both wrist strap 36 and anti-skid top surface 38 constitute coupling means to adequately hold the user's hand to the wrist support. The squiggles on wrist strap 36 indicate a stretchy, resilient material. This is the preferred embodiment.

Functionality of Invention

It is widely accepted that keeping one's wrists straight alleviates carpal tunnel syndrome and mitigates the risks of repetitive stress injuries. All wrist-rests hold typists' wrists or palms above the level of the supporting desk-top. This reduces the amount one's wrists need to bend upward assuming the wrists would otherwise rest on the desk-top.

The Arched Panel Wrist Support prevents much dysfunctional bending of the typist's wrists. In FIG. 12 wrist 53*b* is positioned substantially on the crest of the Arched Panel Wrist Support. In general, this is the posture that optimizes wrist straightening, the primary goal of wrist-rests. In the embodiment of FIG. 12, wrist 53*b* is substantially stuck to the wrist support. Therefore, wrist 53*b* and the wrist support substantially remain in the same relative position.

In the embodiments of the previous figures, the wrist support is fixed and the user's hands slide over it. In these embodiments, the hand may slide from where palm 54*b* is over the crest to where lower forearm 55*b* rests on the crest. Within this range the user's wrist will be well supported and will remain amply straight.

A drawback to resting one's hands when typing is that the hands tend to become set. The typist does not move his/her hands around the keyboard as easily. Consequently, the typist often bends his/her wrists uncomfortably when hitting the less reachable keys. There are several features in the disclosed wrist-rest that promote mobility over the keyboard.

First, raising one's hands to the correct height improves mobility. For a user's wrists to be straight when typing, they must be held well above the keyboard. Standard foam block wrist-rests only raise a user's hands to the level of the front of the keyboard. Since the disclosed wrist-rest is conducive to higher wrist supports, it better prevents users from bending their wrists. Also, the optimum height will vary, depending on various factors including the height of the keyboard and the length of the user's fingers. Fortunately, the Arched Panel Wrist Support can provide several height options inexpensively. This is because die-cutting a range of structure panels 25 is affordable. In sum, the Arched Panel Wrist Support's ability to achieve optimum height enhances mobility.

Second, having a firm wrist support helps in this respect. One's wrist will sink into a sponge or foam wrist support, detracting from mobility. In contrast, the user's hands do not sink into arched panel 25 as with foam. Separately, a slick material for contact fabric 22 is suggested so that the user may slide his/her hands around the keyboard.

Third, a sloping wrist support, as shown in FIG. 7, also can enhance keyboard mobility. People are taught to position their hands squarely and properly onto home-row. On modern computer keyboards, though, there are usually small keypads to the right of the large, main keypad. Even trained typists are often sloppy how they position there hands over the additional keypads. Keyboard users often bend their right hand awkwardly and problematically to access these additional keys. A sloping wrist-rest can help and encourage users to position their hands properly over the supplementary keypads. Returning to home-row is so ingrained that this action is not adversely affected despite the upward incline. Furthermore, it is less straining and more natural to angle one's wrists so the thumb side of the hand is raised relative to the pinky side of the hand.

Figure 13:
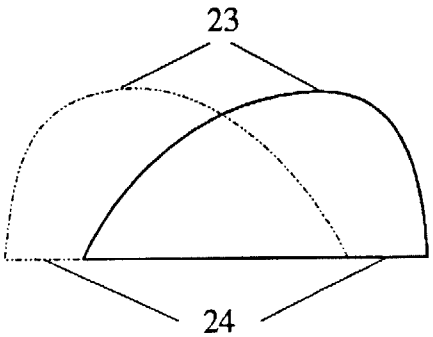
FIG. 13 is a vertical cross-sectional view of the support in FIG. 12, showing the forward and backward sliding motion.

Mobile embodiments, like that shown in FIG. 12, have some advantages. To start, mobile embodiments can have a steeper slope because they are narrower. Also, the units can be used with a computer mouse or similar pointing device. However, there is another unobvious advantage unique to the Arched Panel Wrist Rest. The mobile version can slide better than competing designs both in the forward/backward direction and in the side to side direction. Mobile embodiments slide well from side to side because footing edges 26 essentially act as runners. They also slide well forward and backward because of a sweeping effect. FIG. 13 is a transverse vertical cross-section of the mobile support in FIG. 12, along the plane indicated by 13—13. FIG. 13 shows an alternate position of the wrist-rest to illustrate this sweeping effect that enhances sliding.

Figure 15:
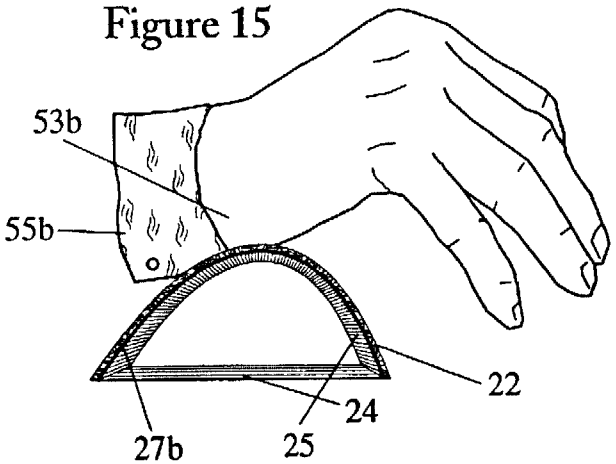
FIGS. 14 and 15 are side views showing how the Arched Panel Wrist Support yields based on the position of the user's hands.
Figure 14:
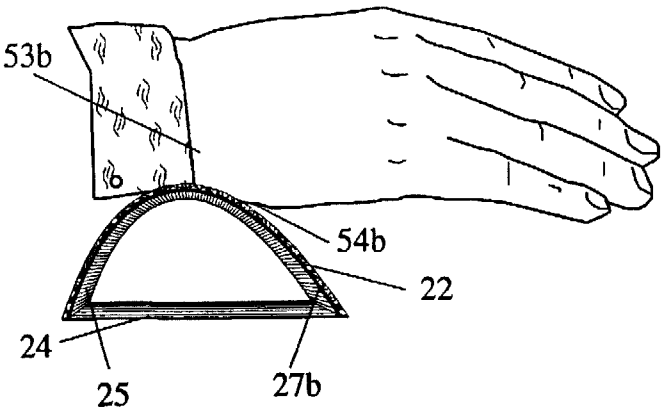

FIG. 14 is a side view of the Arched Panel Wrist Support with a user's fingers in extended position. FIG. 15 is a side view of the Arched Panel Wrist Support with a user's fingers in curled position. Unobviously, the Arched Panel Wrist Support slants in the direction that the user positions and wants to position his/her hands. FIGS. 14 and 15 illustrate this feature.

When the user's hand is in the extended position, as in FIG. 14, the invented wrist-rest flattens at the point of contact with the user. Wrist 53 and palm 54 substantially contact the wrist support. The user's fingers thereby stretch out enhancing the user's reach.

When the user's hand and fingers are in their curled position, the invented wrist-rest slopes upward at the point of contact with the user. Wrist 53 and lower forearm 55 substantially contact the support. This raises the user's fingers, all but eliminating any need to bend the wrist.

This subtle shifting of the arched structure panel 25 does not mean that the wrist-rest is causing the user's wrist to bend. Nor does the shifting mean that the user's hands are less in control than with an unyielding wrist support. The Arched Panel Wrist Support simply yields and conforms to the user's hands. The invented wrist-rest is substantially like typing properly without a wrist-rest. It feels more natural because it moves out of the way. The invented wrist-rest supports the weight of the user's hands and forearms. However, user's wrists can stay in the same position while their fingers alternately extend and curl. The user's wrists may bend within a very narrow range, but this is what happens when a wrist-rest is not present. Moreover, the invented wrist-rest makes curling one's fingers a less tensing movement than with an immovable wrist-rest. This results in the invented wrist-rest being more restful.

The fact that the Arched Panel Wrist Support replicates not using a wrist-rest is another unobvious feature. Since arched structure panel 25 shifts moderately based on hand position, the right and left hands could influence each other. This is why the specification recommends separate right and left hand units. The two wrist supports isolate the motion of each hand. Individual supports eliminate any interplay between the hands. Neither the two-unit embodiment nor its importance has been heretofore contemplated.

Another reason for having multiple structure panels 25 is to provide different slopes. In particular, having a left-hand panel sloping down to the left and a right-hand panel sloping down to the right is a desirable embodiment.

The Arched Panel Wrist Support is surprisingly strong. The structure panels seem flimsy by themselves. However, when structure panel 25 is held in its arched configuration, as described herein, it easily supports the hands and arms of even heavy armed users. Simultaneously, the hard or firm plastic is surprisingly comfortable. The Arched Panel Wrist Rest can feel quite soft due to the slight deformation of the firm panel.

The disclosed wrist rest holds together very well though arched panel 25 is not ordinarily attached to its constraining means. Arched panel 25 does not slide around inconveniently. When not in use, the resiliency of the arched panel keeps it unified with constraining sleeve 20 or panel channel 32. There is an even greater tendency for the Arched Panel Wrist Support to remain in place when in use. The supported weight exerts a spreading force on the arched panel, increasing the frictional force between panel 25 and its constraining means. This in turn adds to the integrity of the structure. These benefits of the disclosed design have not been apparent to those skilled in the art.

SCOPE

Many modifications to the support disclosed will be evident without departing from the scope of the invention. Some presently preferred embodiments have been described above and in the figures. This section discusses other variants of the same invention.

Other arched panel constraining means are available. For example, it is possible to hold structure panel 25 in its arched configuration by means of laces or stringers. Eyelets would be placed along both longitudinal edges. The longitudinal edges would next be strung by a cord to be a fixed distance apart and then tied.

Generally, it is preferred that structure panel 25 be cut from a flat extruded sheet of plastic or that it be molded as a flat panel. First, structure panel 25 being flat ensures that it will press out naturally against the structure panel constraining means. Second, it is easier to manufacture a flat panel. However, structured panel 25 conceivably could be manufactured with an arch or curve in it. The restriction imposed by the present invention is that the arched structure panel 25 is flexible enough to readily have a planar configuration and an arched configuration.

Various dimensions have been suggested in the specification. These are merely examples and not intended to be limitations. The exact dimensions are less important than the proportions. Even with the proportions the design engineer has much latitude without departing from the disclosed invention.

The best materials to use are subject to opinion. For instance, a thin gauge metal structure panel 25 may be more desirable to some because it is more durable than plastic. Contact Fabric 22 may be selected for its electrostatic dissipative properties, instead of for its perspiration absorbent properties.

Many specificities shown may be altered without departing from the invention. For example the location of hand strap 36 is subject to variation. Straps can be attached to the sleeve. They can be attached to the panel. Channel bed 33 may have holes to save on material or ribbing to strengthen the material. Tray platform 46 may be collapsible and not a simple solid sheet. Channel barriers 34 and tray walls may be posts or pegs, as opposed to solid walls. Gliding means other than the slick bottom surface are contemplated. For example, wrist supports having rollers are well known. The back and front edges of structure panel 25 might be wavy, in which case footing edges 26 are the points upon which the arched panel stands.

The many specificities given are designed to illustrate the invention concretely, not to limit the invention to these examples. Thus the scope of the invention should be determined by the appended claims and their legal equivalents.

I claim:

1. A wrist support for upholding a wrist (53) comprising:

a structure panel (25), said structure panel (25) having a pair of footing edges (26) lying substantially in a direction from left to right, said structure panel (25) being flexible enough to readily take on a substantially planar configuration and a substantially arched configuration, where said footing edges (26) are drawn nearer each other, where the body of said structure panel (25) bows upward, where said structure panel (25) forms and straddles a concavity (31), and where the structure panel (25) is made of sufficiently firm material to substantially stand on said footing edges (26) and be adequately supportive, and a means for substantially containing said structure panel (25) in said arched configuration.

2. The wrist support of claim 1 wherein the arched panel constraining means comprises a tubular stretch of material or sleeve (20), said tubular stretch of material (20) comprising flexible material, and said tubular stretch of material (20) substantially wrapping around the structure panel (25) and said concavity (31) by substantially hugging the structure panel when in said arched configuration (25) and the bottom face of said concavity (31), whereby said structure panel is substantially bound in said arched configuration.

3. The wrist support as in claim 1, comprising:

said structure panel having a right structure panel and a left structure panel forming left and right wrist supports right and left structure panels (25) having a pair of footing edges (26), respectively, lying substantially in a direction from left to right, said right structure panel (**25*b*) being flexible enough to readily take on a substantially planar configuration and a substantially arched configuration, where the right footing edges (26) are drawn nearer each other, where the body of said right structure panel (25*b*) bows upward, where said right structure panel (25*b*) forms and straddles a concavity (31), and where the left structure panel (25) is also made of sufficiently firm material to substantially stand on said footing edges (26) and be adequately supportive, and a second tubular stretch of material or sleeve (20) comprising flexible material, and said second tubular stretch of material (20) substantially wrapping around said right structure panel (25*b*) and the right concavity (31) by substantially hugging the convex surface of the right structure panel (25*b*) and the bottom face of the right concavity (31), whereby said right structure panel (25*b*) is substantially bound in said arched configuration, where base materials (24) of the left and right supports are substantially connected along their right and left edges respectively, said base materials (24) being substantially the portions of said sleeves (20) that underlie the concavities (31) and the footing edges (26), whereby one of the wrist supports adapted to support a single wrist (53**), isolating the single wrist's motion, and whereby the coupling of the two wrist supports helps prevent said wrist supports from sliding or shifting.

4. The wrist support of claim 1 wherein the arched panel constraining means comprises:

a substantially planar channel bed (33), said channel bed (33) having a pair of substantially rectilinear, disjoint boundaries, lying substantially in a direction from side to side, and a pair of channel restricting means (34) to block sliding off the channel bed, said pair of channel restricting means (34) lying in one-to-one relation along said pair of boundaries, one of said footing edges (26) of the arched structure panel (25) substantially abutting one of said channel restricting means (34) and the other of said footing edges (26) substantially abutting the other of said channel restricting means (34), said footing edges (26) being positioned on said channel bed (33), whereby said structure panel is substantially held in said arched configuration.

5. The wrist support of claim 4 where one of said channel barrier means (34) comprises:

a means (50) for housing a keypad, and a means for keeping the keypad housing means (50) in a fixed position.

6. The wrist support of claim 1 wherein the arched panel constraining means comprises:

a fairly flat block (38) comprising a slab of appropriately unyielding material, and a pair of substantially rectilinear, disjoint fillisters (40), penetrating the top of said slab (38), said fillisters (40) extending substantially in a side to side direction, one of said footing edges (26) of the structure panel (25) standing in one of said fillisters (40), the other of said footing edges (26) standing in the other of said fillisters (40), whereby said structure panel is substantially held in said arched configuration.

7. The wrist support of claim 1 wherein the arched panel constraining means comprises:

a means (50) for housing a keypad (52), and a substantially planar platform (46), said platform (46) having a front boundary and a back boundary, said boundaries being disjoint and lying substantially in a direction from side to side, and a front wall (**48*a*) adjacent to said platform (46) along said front boundary, and a back wall (48*b*) adjacent to said platform (46) along said back boundary, said walls (48) substantially affixed to said platform (46), and the keypad housing means (50) and the structure panel (25) being seated on the platform (46), one of said footing edges (26) substantially abutting the front wall (48***a*) and the other of said footing edges (26) substantially abutting the front of the keypad housing means (50), and the back of the keypad housing means (50) substantially abutting the back wall (48*b*), whereby wedging the arched structure panel (25) between the front wall (48*a*) and the keypad housing means (50) provides the arched panel constraining means.

8. The wrist support as in claim 1, comprising:

said structure panel having a right structure panel and a left structure panel forming left and right wrist supports right and left structure panels (25) having a pair of footing edges (26), respectively, lying substantially in a direction from left to right, said right structure panel (25*b*) being flexible enough to readily take on a substantially planar configuration and a substantially arched configuration, where the right footing edges (26) are drawn nearer each other, where the body of said right structure panel (25*b*) bows upward, where said right structure panel (25*b*) forms and straddles a concavity (31), and where the left structure panel (25) is also made of sufficiently firm material to substantially stand on said footing edges (26) and be adequately supportive, whereby one of the wrist supports can uphold a single wrist (53), isolating the single wrist's motion.

9. The wrist support of claim 1 wherein said structure panel (25) has said disjoint pair of footing edges (26) nonparallel when in said planar configuration.

10. The wrist support of claim 1 wherein said structure panel (25) is substantially trapezoidal when in said planar configuration.

* * * * *